US006905085B2

(12) United States Patent
Nara et al.

(10) Patent No.: US 6,905,085 B2
(45) Date of Patent: Jun. 14, 2005

(54) PARTICLE PROCESSING APPARATUS

(75) Inventors: Yorioki Nara, Ohta-ku (JP); Takayuki Tanaka, Tokyo (JP); Yoshinori Hanada, Tokyo (JP); Fumiaki Tanabe, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 148 days.

(21) Appl. No.: 10/276,980

(22) PCT Filed: May 21, 2001

(86) PCT No.: PCT/JP01/04233

§ 371 (c)(1),
(2), (4) Date: Nov. 21, 2002

(87) PCT Pub. No.: WO01/89701

PCT Pub. Date: Nov. 29, 2001

(65) Prior Publication Data

US 2003/0106951 A1 Jun. 12, 2003

(30) Foreign Application Priority Data

May 22, 2000 (JP) ..... 2000-149986
Jun. 13, 2000 (JP) ..... 2000-177619
Dec. 28, 2000 (JP) ..... 2000-403274

(51) Int. Cl.[7] ..... B02C 17/16
(52) U.S. Cl. ..... 241/101.2; 241/285.2
(58) Field of Search ..... 241/101.2, 285.1, 241/285.2

(56) References Cited

U.S. PATENT DOCUMENTS 4,480,923 A 11/1984 Mehta
4,501,430 A * 2/1985 Kuhl et al. ..... 277/350
4,524,917 A * 6/1985 Williams ..... 241/101.2
4,733,826 A 3/1988 Komori et al.
5,464,163 A * 11/1995 Zoz ..... 241/172

FOREIGN PATENT DOCUMENTS

| | | |
|---|---|---|
| EP | 0 585 802 A2 | 3/1994 |
| EP | 0 805 480 A2 | 11/1997 |
| JP | 17-10930 Y1 | 9/1942 |
| JP | 6-55053 | 6/1994 |
| JP | U-5-33823 | 5/1998 |

* cited by examiner

*Primary Examiner*—Lowell A. Larson
(74) *Attorney, Agent, or Firm*—Oliff & Berridge, PLC

(57) ABSTRACT

A part of an outer wall composing a clean box 2 becomes a component of a particle processing apparatus, a processing chamber 31 and the clean box 2 are integrated, the entire apparatus can be made compact, and in accordance with such compactness, even when a shaft sealing means 6 and an oil sealing means 323 are disposed in proximity to each other, reliable shaft sealing performance is secured, whereby a shaft sealing structure enabling processing of fine particles by high speed rotation is provided.

Furthermore, integration of setting means for components accompanied with assembly and disassembly of the processing chamber is achieved, the entire assembling structure is simplified and the assembly work is made easier, whereby a particle processing apparatus the assembly and disassembly of which accompanied with cleaning work can be easily carried out in a short time without loss of productive efficiency.

Moreover, use requiring a raw material supply unit 7 and use involving no necessity of a raw material supply unit 7 can be selectively achieved in a balanced manner in accordance with a supply manner for production in view of attachment and detachment accompanied with cleaning work, and this reduces the work burden of attachment, detachment, and cleaning of the supply unit 7 itself.

24 Claims, 8 Drawing Sheets

PARTICLE PROCESSING APPARATUS

BACKGROUND OF THE INVENTION

1. Field of Invention

The present invention belongs to the technical field of various particle processing apparatuses including particle surface modification units, crushers, mixers, kneading machines, granulating machines, feeders, and drying machines, and particularly relates to a particle processing apparatus suitable to the fields of medical products and food products, whose disassembling frequency and cleaning frequency are high.

2. Description of Related Art

Generally, in case of processing a particulate material such as a medicine (progenitor), a particle processing apparatus had been set inside a clean room building that had been closed to prevent mixture of foreign matter, and processing work had been carried out inside the room. Recently, however, in place of such a large-scale clean room building, in order to reduce the cost of equipment and running costs, so-called clean box-integrated particle processing apparatuses have been employed which house the above-mentioned various particle processing apparatuses in clean boxes having sizes suitable to the processing purposes.

However, for integration with a clean box it is, of course, required to realize compactness of the entire apparatus, and particularly, a particulate material to be processed by this apparatus is mostly an expensive medicine (progenitor), the amount to be processed is small, and various kinds are to be processed. Therefore, the processing material is frequently changed, and assembly, disassembly, and cleaning works for the processing chamber are required for each change. There are several themes and problems to be solved such as procedure simplification as well as improvement in practicability.

A first theme relates to compactness of the entire apparatus accompanied with an improvement in shaft sealing structure. Namely, describing a conventional crusher as an example, at a distance from an outer wall composing a clean box, a particle processing chamber (crusher) is disposed inside, and a rotary shaft of a drive mechanism provided outside is made to penetrate through the outer wall and connected to a rotor that is provided inside the particle processing chamber. The particle processing chamber is only independently housed in the clean box via the rotary shaft so as to be isolated from the clean box outer wall. Therefore, when cleaning the inside of the clean box and the particle processing chamber, cleaning of the back surface side of the processing chamber is difficult, so that the area around the rotary shaft penetrating portion with respect to the outer wall portion is notched so that this notched circumferential portion becomes attachable to and detachable from the box main body outer wall via a fixture such as a bolt, and after the drive mechanism is removed from the base, the particle processing chamber is taken out from the inside of the box while it is connected to the drive mechanism and then disassembled. In cleaning work, such assembly and disassembly works are troublesome and take time.

In addition, for prevention of entering of external dust into the box through a gap at the portion of the outer wall penetrated by the rotary shaft, a simple sealing means is employed in which a cleaning gas such as an N2 gas is filled inside the box and exhausted from the gap at the penetrated portion to the outside, or in addition to this, the gap is closed by a cover.

Therefore, when crushing particles into fine particles, in the abovementioned sealing means in which a cleaning gas is only filled inside the box, the fine particles flow out together with the gas from the gap at the penetrated portion although such a problem does not occur in case of coarse crushing of particles.

Furthermore, with this structure, combined with the simple sealing means, in the arrangement structure with the clean box, the distance from the bearing to the rotor lengthens, so that a structural design involving an increase in the diameter of the rotary shaft is required, resulting in a large scale of the apparatus itself. Furthermore, in a case where the rotor is rotated at a high speed, an available bearing and oil sheet are limited. Under the circumstances, it has been desired to develop a processing apparatus that is used as a processing apparatus for processing by rotation at a comparatively low speed, and is compact and can also adapt to high speed rotation processing and fine particle processing.

On the other hand, in the case of use as a device for high speed rotation, it is necessary that the distance from the bearing to the rotor is made as short as possible to shorten the rotary shaft, the bearing is lubricated by a lubricating oil, an oil sealing means is provided to prevent the lubricating oil from entering the inside of the clean box or processing chamber, and a shaft sealing means is provided to prevent particles inside the processing chamber from entering the bearing side.

The conventional shaft sealing means employed for high speed rotation is generally called single gas sealing, which has a bearing built-in shaft sealing structure in which a shaft scaling part is laid across the processing chamber and the bearing, and the shaft sealing part is provided with a circulating path for supply and exhaust of a shaft sealing gas.

Therefore, even when the pressure inside the processing chamber increases, by adjusting the valve of the shaft sealing gas outlet, the shaft sealing gas ejection amount to the inside of the processing chamber can be adjusted, however, in a case where the oil sealing means is disposed in proximity, even if a labyrinth structure is provided to increase the flowing resistance or an oil thrower is provided at the shaft sealing part, (1) there is a possibility that the lubricating oil enters the inside of the processing chamber, (2) there is a possibility that particles enter the bearing, and (3) it is not possible to detect an increase in pressure inside the processing chamber although it is possible to adjust the shaft sealing gas ejection amount to the inside of the processing chamber. In all of these cases, these conventional shaft sealing means cannot be employed as they are.

A second theme relates to simplification of processing chamber assembly and disassembly works. Namely, in the related art, as shown in FIG. 7 and FIG. 8, an impact pulverizer is divided into a particle processing chamber 1*a* side and a drive mechanism 2*a* side based on a rear cover 101*a* that is an attaching structure (the figure includes up to the bearing means and coupling portion, and a motor is not shown). A stator (casing) 102*a* and a front cover 103*a* as components to be provided at the processing chamber 1*a* side are attached to the rear cover 101*a* in a laminating manner, and these cannot be disassembled.

Namely, the stator 102*a* is screw-fixed to the rear cover 101*a* from the back surface side, and the rear cover 101*a* and the front cover 103*a* are connected by a fixing means including removable joint shafts 3*c* pivotally attached through shaft holes made in connecting parts 3*a*, 3*b* formed at one-end sides of the covers, and the front cover 103*a* is horizontally rotatable around the joint shaft 3*c*. Furthermore, at the other ends, a tightening handle 4*a* provided so as to be rotatable horizontally on the rear cover 101*a* is engaged in a concave groove 4*b* formed at the front cover 103*a*, and when a tightening operation of the handle is carried out, the front cover 103*a* is pressure-contacted with the stator 102*a* to close the covers.

To disassemble the assembled components, first, the tightening handle 4*a* is loosened to release the engagement with the concave groove 4*b*, the joint shaft 3*c* is removed, and the cover 103*a* is removed. Then, the stator 102*a* attached to the rear cover 101*a* is removed to complete disassembly, and it becomes possible to carry out cleaning work of the respective components.

However, with this construction, since the front cover 103*a* and the stator 102*a* are attached to the rear cover 101*a* by separate setting means, the structure becomes complicated, and when assembly and disassembly works are carried out, a screw tightening operation while supporting the members is required, and particularly in disassembly, supporting must be continued for a long period of time until all the screws are removed, and therefore, it is difficult for one operator to carry out these works by himself/herself, and working efficiency is low. During cleaning work, due to the existence of the connecting part 3*b* at the front cover 103*a*, the existence of the connecting part 3*a* and the tightening handle 4*a* at the rear cover 101*a*, and the existence of the setting means, cleaning of inside holes of connecting parts 3*a*, 3*b*, corners of an attachment base, the rotating joint of the tightening handle 4*a*, the tightening screw portions, and the screw holes at the stator 102*a* is difficult and takes time, and furthermore, when the components form a multi-layered structure due to addition of a casing composing the shaft sealing part, the cleaning work takes more time. Particularly, in a case where the material to be processed is frequently changed, the assembly, disassembly, and cleaning work frequencies inevitably increase, and this lowers the productive efficiency, and causes defective cleaning.

When a particulate material such as a medicine (progenitor) is processed, a so-called clean box-integrated particle processing apparatus in which a particle processing chamber is housed in a clean box that is sealed so as to prevent entering of foreign matter is used, however, in this case, working efficiency further lowers.

A third theme relates to the processed states and the raw material supplying means. Namely, although the amount to be processed at a time in the processing chamber depends on the physical properties of the raw material to be processed, supply of a quantitatively-controlled amount is desirable to generate ground particles without unevenness in particle size.

Conventionally, the front surface side of the box outer wall is constructed as an operating part, and an operator inserts his/her hands into right and left arm gloves for maintenance provided at the operating part, and manually supplies a raw material to a raw material hopper by using a quantitatively-controlled amount cup, whereby raw material supply to the processing apparatus installed inside a clean box is carried out.

However, in a production process requiring continuous supply of the same kind of raw material, it is very difficult for such a manual supply to cope with continuous supply since such a manual supply not only lowers the working efficiency but also requires a high-level of skill for a uniform supply over a long period of time. Accordingly, an automatic supply unit for supplying a quantitatively-controlled amount of material is proposed, however, in the special environment inside a clean box, it is necessary to select which should be used, manual supply or supply by the automatic supply unit balancing between short-time supply and long-time supply, and in addition, sealing performance inside and outside the box and workability in assembly and disassembly accompanied with cleaning work must be taken into consideration, and it has been demanded to develop a quantitatively-controlled amount supply unit that is suitable to special usage of a clean box.

SUMMARY OF THE INVENTION

The present invention has been made to achieve the above-mentioned themes, and an object thereof is to provide a particle processing apparatus structured so that a particle processing chamber is securely supported by the outer wall surface of a clean box, the particle processing chamber and the clean box are integrated, a rotary shaft inside the clean box can be shortened, high speed rotation of a rotor is made possible, and the respective members composing the particle processing chamber and a shaft sealing means can be disassembled while the clean box and a drive mechanism are attached to a base, whereby disassembly and assembly accompanied with cleaning work can be easily carried out in a short time.

Another object of the invention is to provide a particle processing apparatus structured so that, even when a shaft sealing means and an oil sealing means are provided in proximity to each other for compactness of the entire apparatus, entering of a lubricating oil at the bearing into the first shaft sealing means at the particle processing chamber side and entering of particles into the oil sealing means can be securely prevented by a second shaft sealing means at the drive mechanism side, adjustment, management, and control of a gas supply amount can be easily carried out, the product yield gained from particle processing is improved, necessity of replacement due to breakage of the oil sealing means or influence from breakage of the oil sealing means on the entire apparatus can be eliminated or reduced to a minimum, and processing of fine particles by high speed rotation is enabled even inside a clean box that is required to be compact.

Still another object of the invention is to provide a particle processing apparatus structured so that setting means for components accompanied with assembly and disassembly works are integrated to make it possible to simplify the entire assembling structure and reduce the number of parts, and even when the components form a multi-layered structure, the components can be set in a temporarily assembled condition in a multi-layered manner by an easy operation of only supporting the respective components with a supporting member, it becomes unnecessary to continuously support the components during the works, only one operator is able to easily carry out the works by himself/herself, and this simplifies the assembly work and improves the working efficiency, and in addition, it becomes possible to employ a general fixing means such as a combination of bolts and nuts, necessity of additionally providing a fixing means and tightening handle can be avoided, and formation of projections and holes due to the existence of these members can be eliminated as much as possible, not only disassembled components but also an attaching structure for attaching these components can be easily cleaned, and therefore, even when the assembly, disassembly, and cleaning frequencies increase, the productive efficiency is maintained, and even inside a clean box at which such work is difficult to perform, disassembly and assembly accompanied with cleaning can be easily carried out in a short time.

Still another object of the invention is to provide a material supply unit for a clean box, structured so that the changeover between a case requiring a quantitatively-controlled amount supply and a case not-requiring a quantitatively-controlled amount supply can be made depending upon the processing amount of material and the state of supply while securing scaling performance inside and outside the clean box, and for example, when the material changing frequency increases and use without a supply unit is required, material supply can be directly carried out from a predetermined raw material hopper, and even when assembly, disassembly and cleaning of the processing chamber are frequently carried out, and not to mention the case where the entire supply unit is removed, even in a condition where the supply unit is attached, it is not especially forced to carry out the cleaning work of the supply unit, and when use with the supply unit is required, attachment and detachment of the entire supply unit or only a supply portion is selectively carried out balancing between short-time supply and long-time supply, and combined with the case where the supply unit is unnecessary, necessary attachment and detachment of the processing chamber can be carried out at a frequency lower than that of assembly, disassembly, or cleaning, and therefore, in comparison with a structure always attached with a supply unit, balanced use can be achieved between attachment and detachment accompanied with cleaning work and attachment and detachment in accordance with necessity and needlessness of a quantitatively-controlled amount supply, and this reduces the work burden.

A technical means employed in the present invention for achieving the abovementioned themes is a particle processing apparatus structured so that, via an outer wall composing a clean box, a particle processing chamber is provided inside the box and a drive mechanism having a drive rotary body is provided outside the box, and a rotor provided inside the processing chamber and the drive rotary body are joined with each other, wherein the outer wall of the clean box and a base on which the drive mechanism is installed are attached as a unit via a sealing means so that sealing performance inside and outside the box is maintained from the outside of the outer wall, and the processing chamber is made into close contact with the outer wall via a casing provided inside the clean box and is formed to be capable of disassembly inside the box.

Furthermore, a technical means employed in the present invention for solving the abovementioned problems is a particle processing apparatus structured so that a drive rotary body of a drive mechanism is inserted via a shaft sealing means into a particle processing chamber, and a rotor interlocked and rotatably joined with the drive rotary body is provided, wherein the shaft sealing means is composed of a first shaft sealing means for restraining particles to be processed in the particle processing chamber from entering the drive mechanism side, and a second shaft sealing means provided between the first shaft sealing means and the drive mechanism, and the second shaft sealing means restrains entering of particles to the drive mechanism side and entering of foreign matter to the first shaft sealing means by allowing entering of particles from the first shaft sealing means and entering of foreign matter from the drive mechanism side.

Furthermore, a technical means employed in the present invention for achieving the abovementioned themes is a particle processing apparatus structured so as to be divided into a particle processing chamber side and a drive mechanism side via a predetermined attaching structure such as a base, a casing, or a frame plate, wherein, when attaching optional components such as a casing, a stator, and a front cover to be provided at the processing chamber side to the attaching structure in a multi-layered manner capable of disassembly, a pair of supporting members having tightening means at the front ends are supported on the attaching structure at one-side ends (in cantilever manner), and on the other hand, engaging arms to be engaged with the supporting members are formed on the respective components, and the components are provided in a manner with capability of disassembly by supporting and fixing the engaging arms to the supporting members by the tightening means.

Furthermore, a technical means employed in the present invention for achieving the abovementioned themes is a particle processing apparatus structured so that, via the outer wall composing a clean box, a particle processing chamber is provided inside the clean box, a drive mechanism having a drive rotary body is provided outside the clean box, and a rotor provided inside the processing chamber and the drive rotary body are interlocked and connected to each other, wherein, when attaching a supply unit for a quantitatively-controlled amount supply of a raw material into the processing chamber, the supply unit is composed of a supply part and a drive part which are linked to each other by a predetermined link means in a manner enabling them to unlink, an attaching hole for supply unit attachment is made in the outer wall above the location at which the processing chamber is provided, the drive part is faced to the inside of the box and attached to the outside of the attaching hole so that a means for linkage with the supply unit is formed at the attaching hole portion, and the supply unit is attachable to and detachable from the inside of the box together with the link means.

BRIEF DESCRIPTION OF THE DRAWINGS

The invention will be described with reference to the drawings, in which.

DETAILED DESCRIPTION OF PREFERRED EMBODIMENTS

Hereinafter, an embodiment of the invention will be described in detail based on a clean box-integrated particle processing apparatus illustrated as a preferred embodiment.

Figure 1:
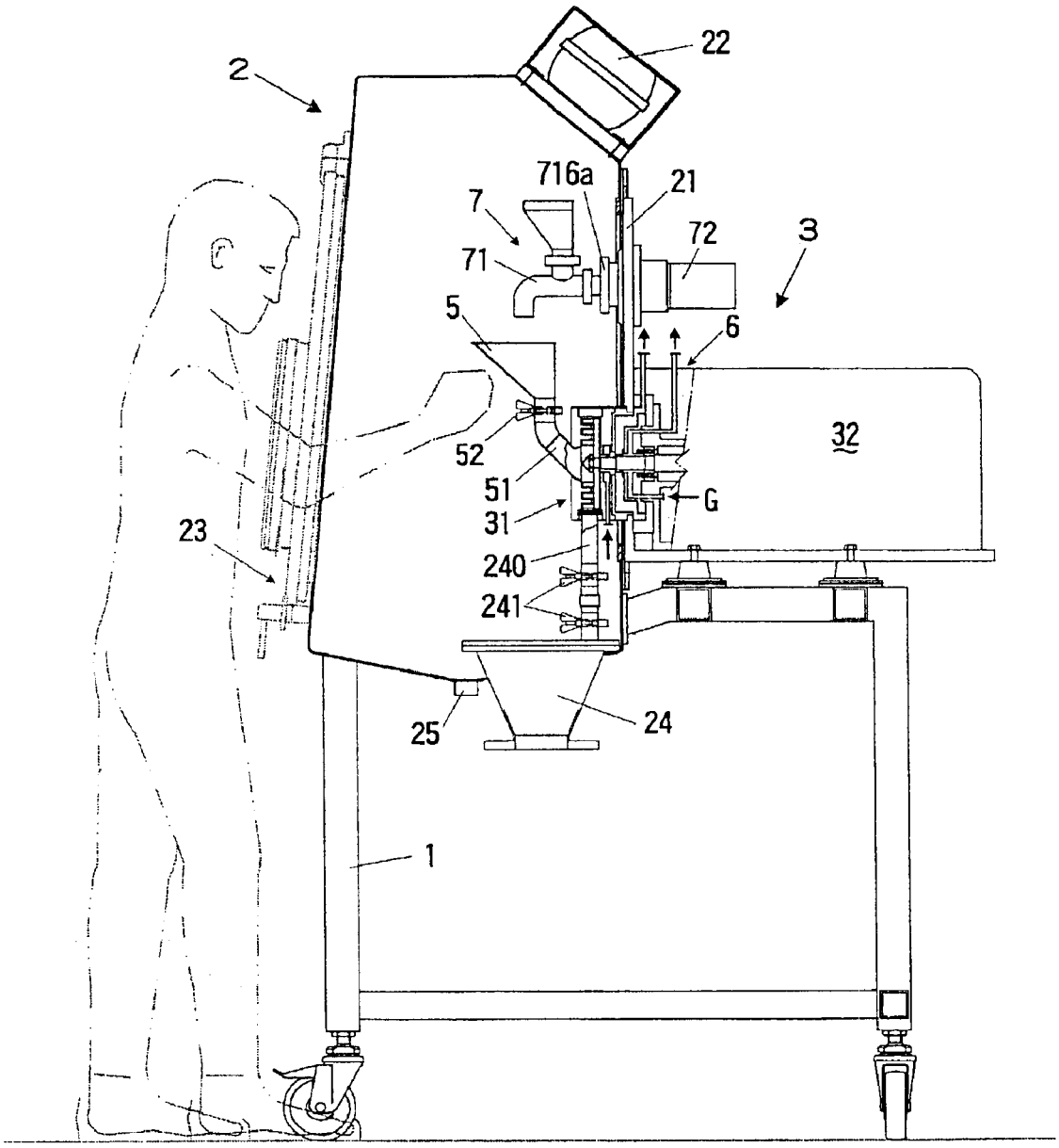
FIG. 1 is a main part cutaway general view of a clean box-integrated particle processing apparatus.
Figure 2:
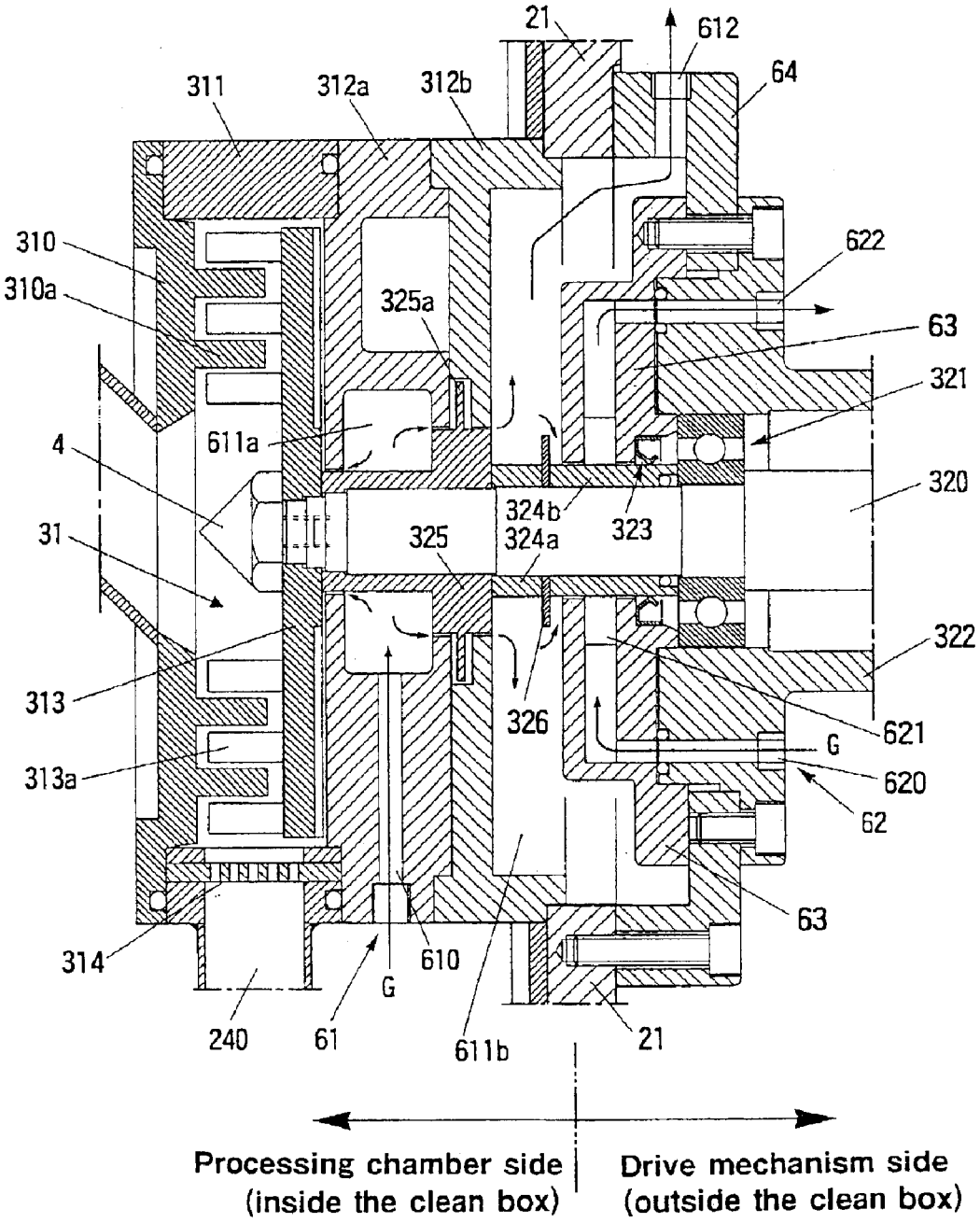
FIG. 2 is a detailed sectional view of the main part cutaway portion of the processing chamber section of FIG. 1.
Figure 3:
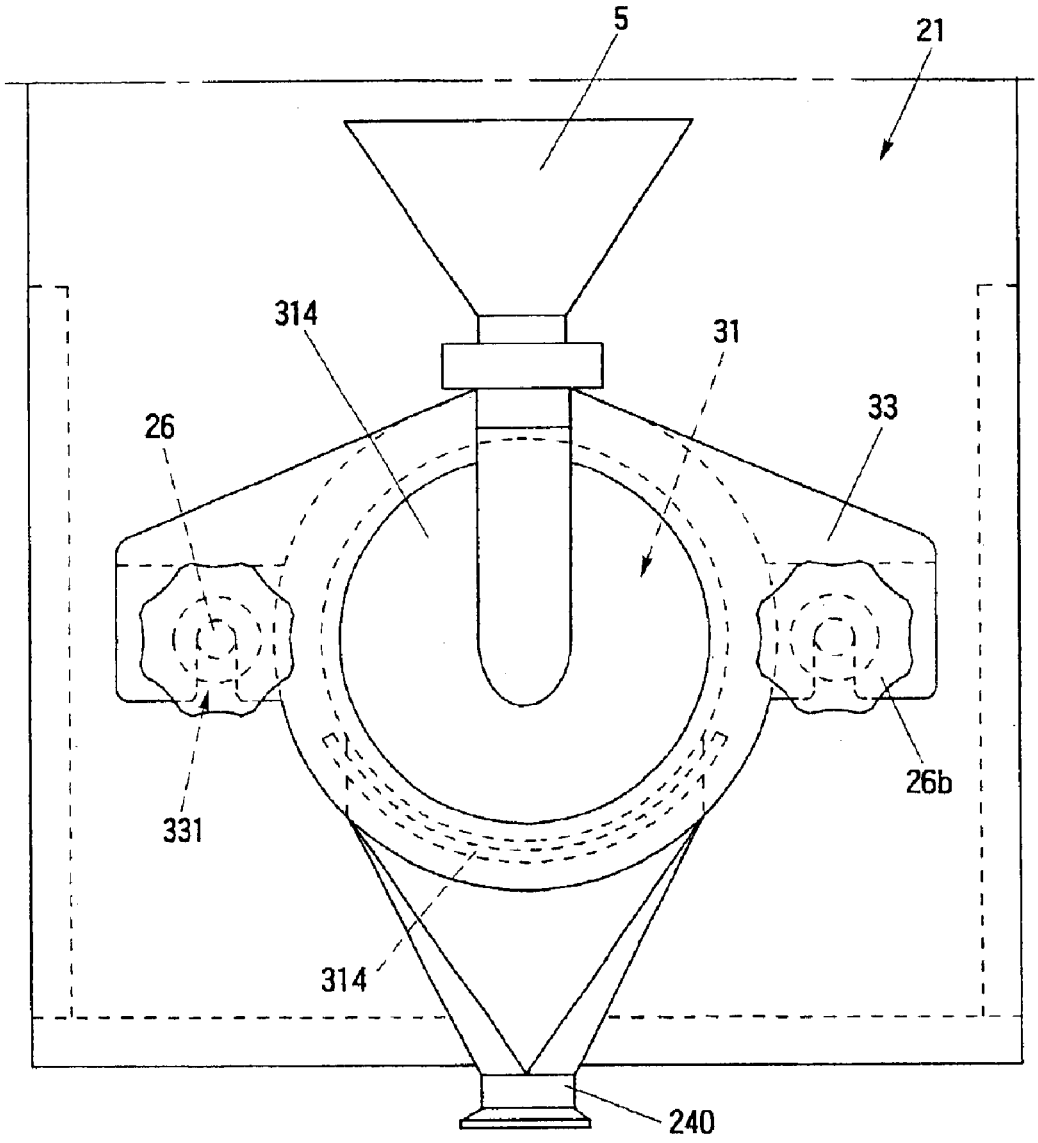
FIG. 3 is a front view of the particle processing apparatus.
Figure 4:
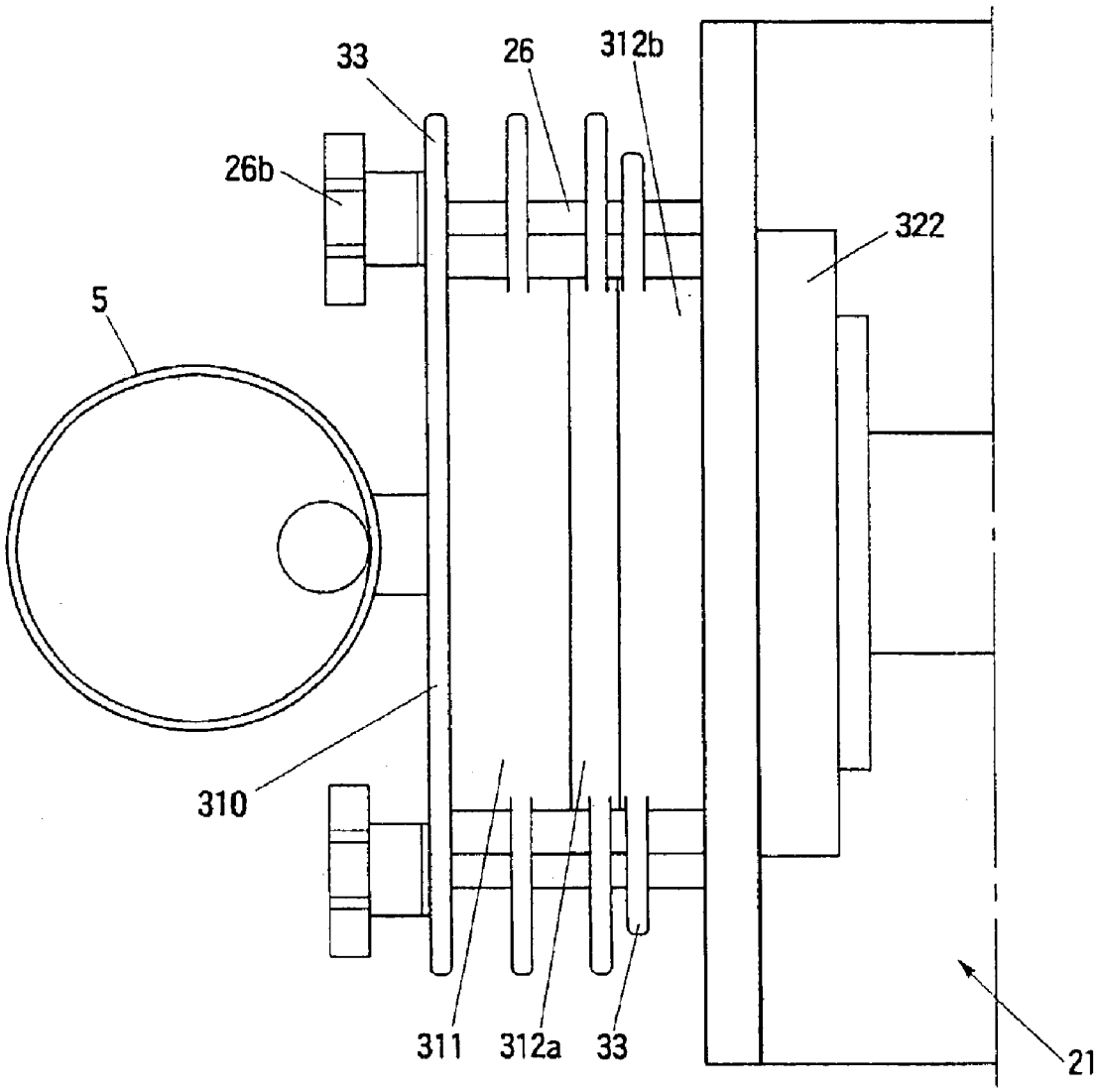
FIG. 4 is a plan view showing the particle processing chamber side.
Figure 5:
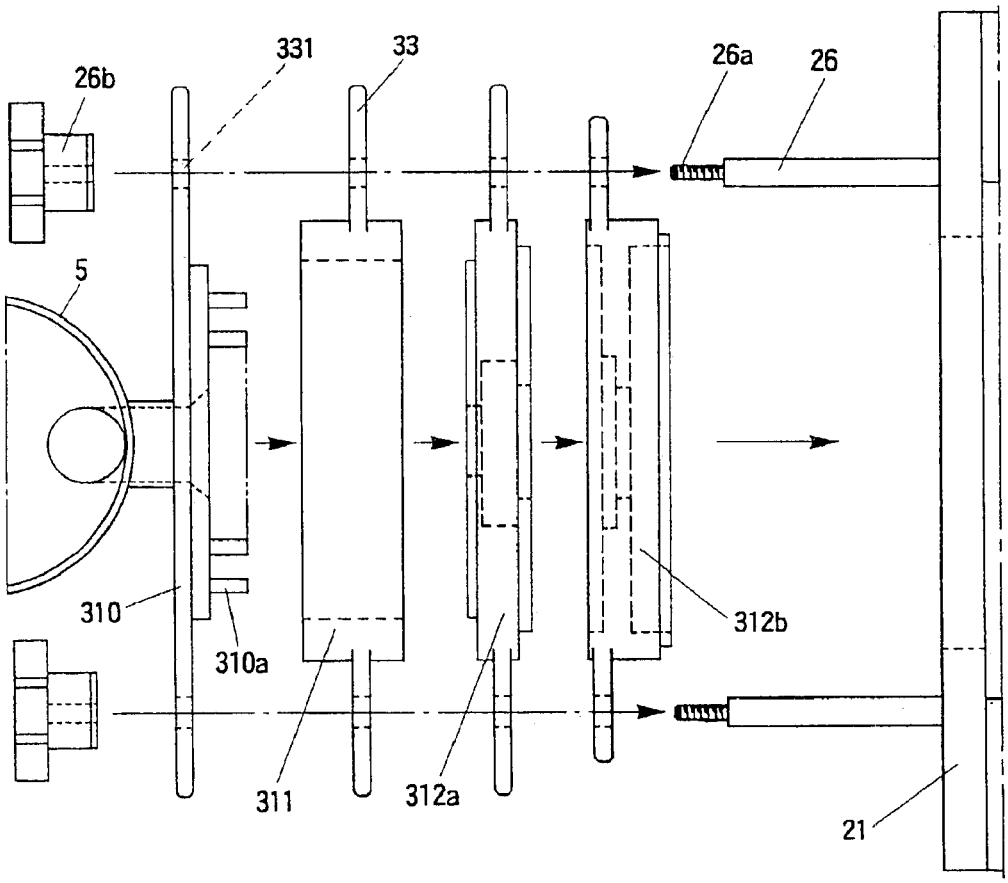
FIG. 5 is an exploded plan view showing components at the particle processing chamber side.
Figure 6:
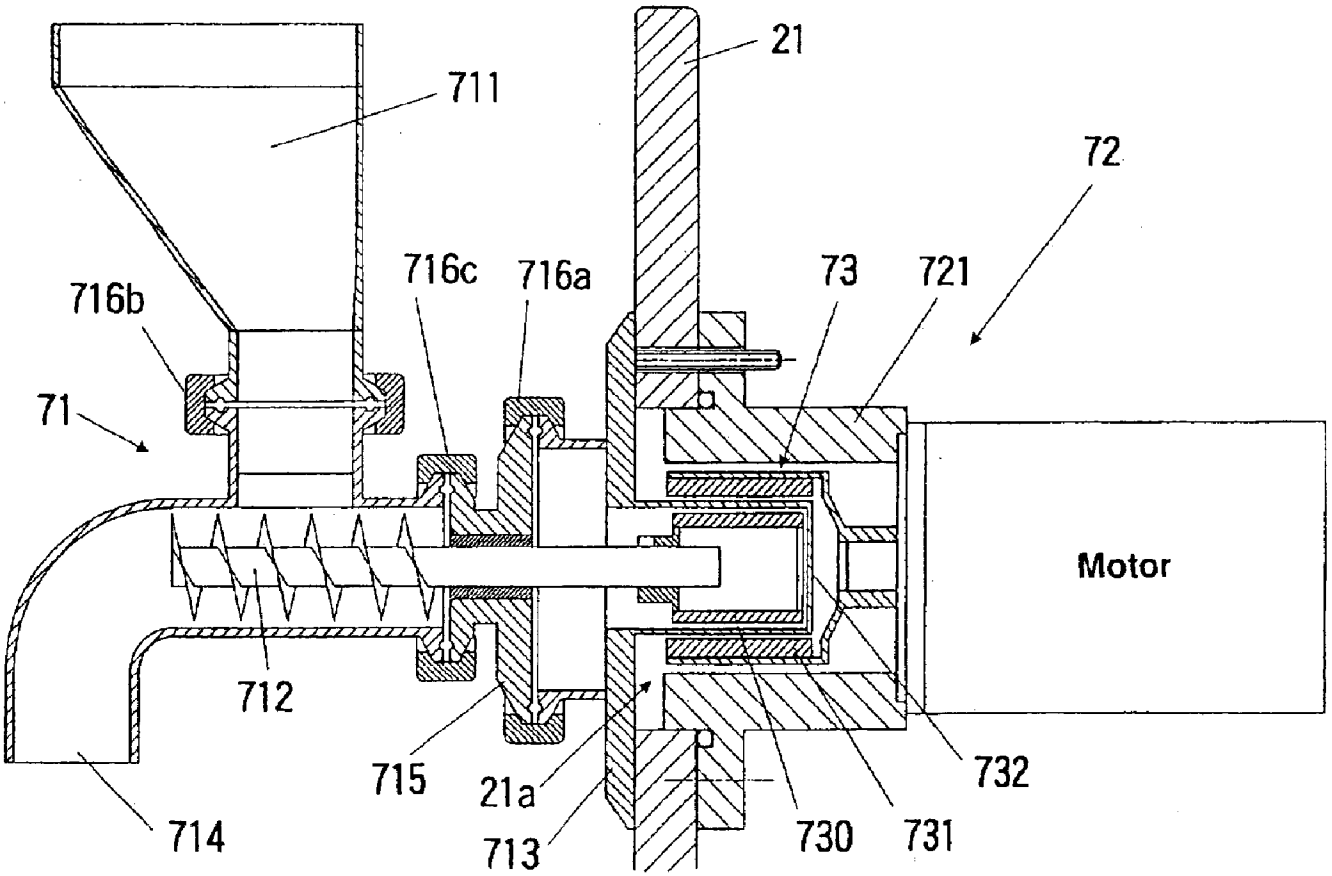
FIG. 6 is a main part detailed sectional view of the supply unit of FIG. 1.
Figure 7:
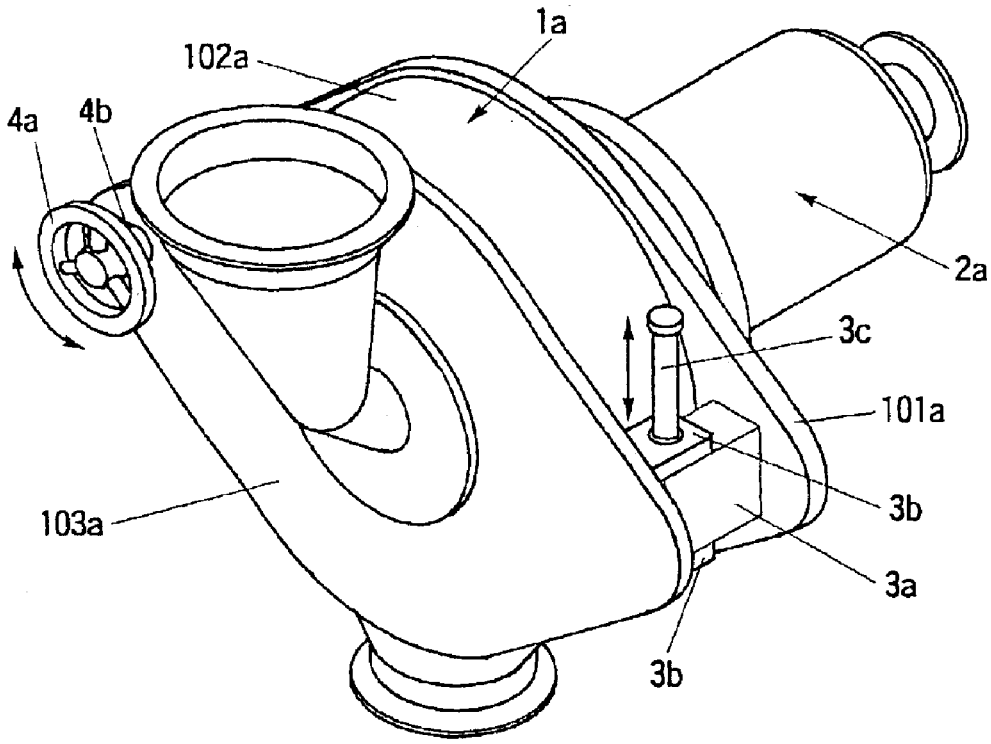
FIG. 7 is a perspective view showing a conventional impact pulverizer.
Figure 8:
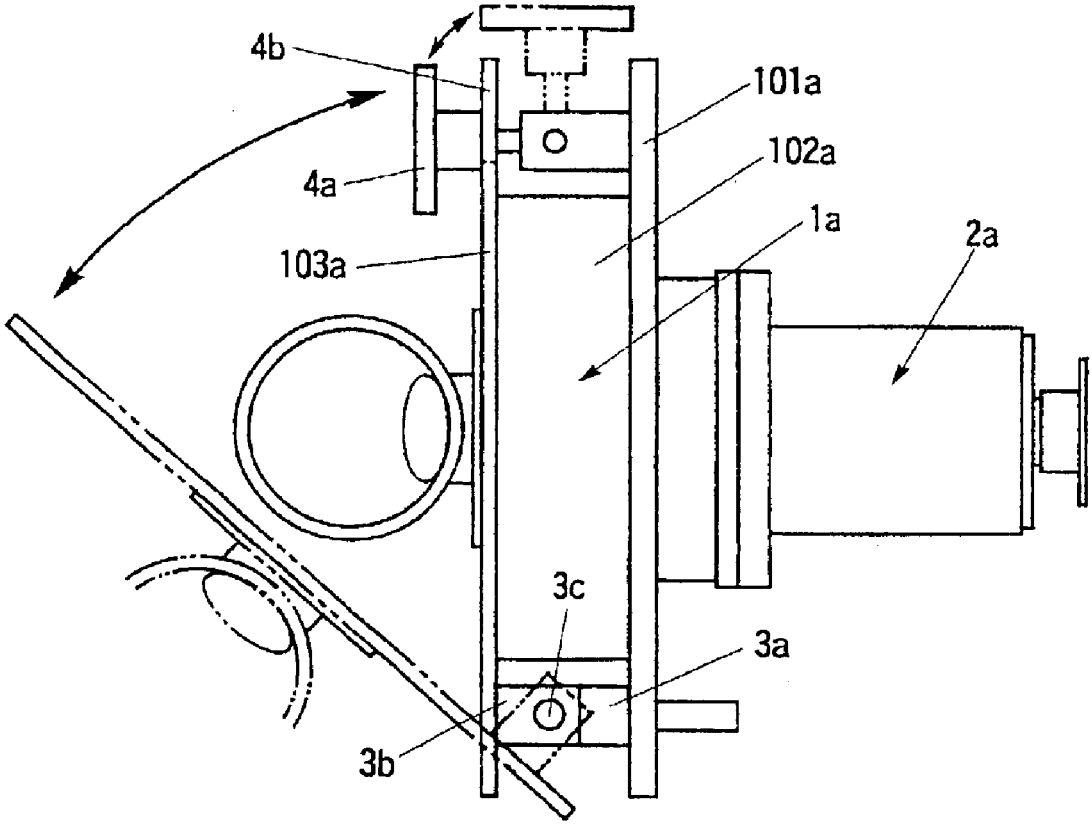
FIG. 8 is a plan view showing the conventional impact pulverizer.

In FIG. 1 through FIG. 6, the reference numeral 1 denotes a frame-shaped base with casters, and a clean box 2 and a one-pass type impact pulverizer 3 that is a detailed example of the particle processing apparatus are integrally attached. In the impact pulverizer 3, via an L-shaped frame plate 21 as an attaching structure forming a part of the outer wall of the clean box 2 provided with a predetermined opening, a particle processing chamber (pulverizing chamber) 31 is provided inside the clean box and a drive mechanism 32 is provided outside the clean box, and the processing chamber 31 and the drive mechanism 32 are integrally attached by a sealing means (seal boxes 63 and 64), described later, so as to maintain airtightness inside and outside the clean box from the outside. The drive mechanism 32 is fixed to the L-shaped frame plate 21.

In the clean box 2, a light unit 22 is provided at the upper portion, an operating part 23 structured so as to entirely open and close is provided on the front surface, and a discharge chute 24 for collecting and discharging of pulverized materials is provided on the bottom. At the lower portion of the discharge chute 24, a collector (collecting container) is provided in a continuous manner from a split butterfly valve (these are not shown) so that the pulverized materials can be collected and sealed without contact with outside air. At the operating part 23, right and left arm gloves are provided into which an operator inserts his/her hands to carry out raw material supply or maintenance of the processing chamber 31.

At the processing chamber 31 side, components including a casing 312*b*, a casing 312*a*, a ring-shaped stator 311, and a front cover 310 are provided in a multi-layered manner in close contact with the frame plate 21, and inside the processing chamber 31, a rotor 313 interlocked and joined with a drive rotary shaft 320 of the drive mechanism 32 is rotatably provided and fixed to the rotary shaft 320 by a bolt 4. The components are attached to opposing contact surfaces via O-rings in the abovementioned order.

Namely, a pair of supporting members 26, 26 that are formed into columnar rods are supported at one-end sides on the frame plate 21, and the respective components are integrally provided with engaging arms 33 that are projected on the right and left so as to engage the supporting members 26, and the engaging arms 33 are supported with the supporting members 26.

Namely, the engaging arms 33 have a function as holding parts to set the components, the engaging arm 33 of the casing 312*b* is shaped smaller than that of other components including the front cover 310, and downward concave grooves 331 formed at the engaging arms 33 are engaged with the supporting members 26.

On the other hand, after having placed each component over the supporting members 26, 26 by pressing the front cover 310 by a tightening operation with tightening means provided at the front ends of the supporting members 26, that is, bolts (male screws threaded at the front ends of the supporting members 26) 26*a* and knob nuts 26*b*, the stator 310 and casings 312*a* and 312*b* between the cover 310 and the frame plate 21 are pressure-contacted and attached to the frame plate 21 side. Thereby, the processing chamber 31 is integrally supported on the frame plate 21. Accordingly the processing chamber 31 is structured so as to be integrated with the clean box 2 and the sealing means so that these components and the rotor 313 can be easily disassembled.

In place of the knob nuts 26*b*, of course, general nuts such as butterfly nuts can be used, and for the tightening means, not only a combination of bolts and nuts but also other members such as a handle lever or a clamp can be employed only under a condition where they can pressure-contact the components with the frame plate 21 side.

The reference numeral 5 denotes a raw material pouring hopper provided on the processing chamber 31, 51 denotes a raw material pouring tube, 52 denotes a clamp for detachably joining the opposing opening end faces of the raw material hopper 5 and the raw material pouring tube 51 with each other. A discharge tube 240 is for discharging pulverized materials to the discharge chute 24 from an opening made by notching a part of the stator 311, and clamps 241 detachably join the opposing opening end faces of the discharge tube 240 and the short tubes continuously provided on the upper surface of the discharge chute 24 with each other. Furthermore, a screen (stamped porous plate) 314 adjusts the particle size of pulverized materials.

On the opposing surfaces of the front cover 310 and the rotor 313, a plurality of impact pins 310*a* and 313*a* are radially provided so as to be opposed to each other around the rotary shaft core of the rotary shaft 320 at predetermined intervals in the radial direction and the circumferential direction, and when the rotor 313 rotates, the impact pins 313*a* rotate between impact pins 310*a* in the shaft core direction. Thereby, a pulverizing material (raw material) poured from the raw material hopper 5 into the processing chamber 31 through the pouring tube 51 receives momentary impacts from a number of impact pins 313*a* on the rotor 313 which are rotating at a high speed and impact pins 310*a* on the front cover 310, and collides into the surrounding stator 311, whereby the material is pulverized. Pulverized materials smaller than the pore diameter of the screen 314 are quickly discharged from the discharge chute 241 through the discharge tube 240 accompanied with air flows in accordance with rotation of the impact pins 313*a*, separated into an air flow and pulverized materials by a bag filter that is continuously provided on the upper surface of the discharge chute 241 and is not shown, and the air flow is exhausted into the clean box 2 and the pulverized materials are collected by the collector that is not shown.

Furthermore, in place of the impact pins 313*a*, blades may be radially provided on the outer circumference of the rotor 313 at predetermined intervals, however, in this case, no impact pins and blades are provided on the front cover 310.

The rotary shaft 320 is pivotally supported by a bearing 321, and this rotary shaft 320 is directly connected to the motor that is the drive mechanism 32 or connected to this motor via a transmitting means such as a V belt in a rotatable manner. An oil seal 323 is fitted to the inner circumferential surface of the seal box 63 to seal the bearing 321 portion and prevent a lubricating oil from leaking to the outside, and the outer circumferential surface of a cylindrical collar 324*b* externally fitted to the rotary shaft 320 slides the lip front end of the oil seal 323.

A shaft scaling means 6 is provided between the processing chamber 31 and the oil seal 323 to restrain the lubricating oil at the bearing 321 portion from entering the processing chamber 31 and restrain materials pulverized in the processing chamber 31 from entering the drive mechanism 32 side, and is composed of a first shaft sealing means 61 and a second shaft sealing means 62 provided so as to oppose the outer circumferential surfaces of the collars 324*a*, 324*b*, and 325 which form the drive rotary body together with the rotary shaft 320.

By commonly using seal boxes 63, 64 that are components of the first shaft sealing means 61 as components of the aforementioned sealing means, the first shaft sealing means 61 is formed between the opposing surfaces of the processing chamber 31 and this sealing means. Namely, the first shaft sealing means 61 is composed of an annular groove

611*a* formed by notching a portion of the casing 312 opposite to the collar 325 so as to have a rectangular section, a gas supply passage 610 which perforates the casing 312*a* so as to communicate with the annular groove 611*a* and to supply a sealing gas G, a sealing gas G annular groove 611*b* formed in a condition where the frame plate 21 is held between the casing 312*a* and the seal boxes 63, 64, and an exhaust passage 612 perforating the seal box 64 so as to communicate with the annular groove 611*b*. A disk-shaped labyrinth ring 325*a* is projectingly provided on the outer circumferential surface of the collar 325, and forms a labyrinth seal in conjunction with the annular groove surrounding the labyrinth ring 325*a*. The annular groove 611*a* and the processing chamber 31 are communicated with each other through a shaft sealing gap formed between the collar 325 and the casing 312*a*, and the annular grooves 611*a*, 611*b* are communicated with each other through a shaft sealing gap formed between the collar 325 and the casings 312*a*, 312*b* and the labyrinth seal.

Thereby, a first circulating path for supply and exhaust of the sealing gas G is formed.

On the other hand, the second shaft sealing means 62 is formed at the drive mechanism 32 side using the sealing means of the seal boxes 63, 64 as components thereof. Namely, the second shaft sealing means is composed of an annular groove 621 formed by notching a portion of the seal box 63 opposite to the collar 324*b* so as to have a rectangular section, and a gas supply passage 620 and a gas exhaust passage 622 which perforate a bracket 622 and the seal box 63, and are provided so as to communicate with this annular groove 621 for supply and exhaust of the sealing gas G. The annular groove 611*b* and the annular groove 621 are communicated with each other through a shaft sealing gap formed between the collar 324*b* and the seal box 63, and the oil seal 323 and the annular groove 621 are communicated with each other through a shaft sealing gap formed between the collar 324*b* and the seal box 63.

A disk-shaped oil thrower 326 is attached and sandwiched between the collars 324*a* and 324*b*.

Thereby, a second circulating path for supply and exhaust of the sealing gas G is formed.

Furthermore, gas supply lines are joined with the gas supply passages 610, 620, gas exhaust lines are joined with the gas exhaust passages 612, 622, flow rate adjusting valves are continuously provided in the middle of the gas exhaust lines, and filters are continuously provided at the front ends of the exhaust lines although these are not shown.

Next, a method for operating the shaft sealing means 6 will be described. Inside the clean box 2, various processings are carried out after replacement with an N2 gas, and the N2 gas is continuously supplied and exhausted during processings, and in a case where it is not allowed that outside air enters the inside of the clean box 2, the inside of the clean box 2 is controlled to a slightly positive pressure (100 to 200 Pa), and in a case where it is not allowed that the processed materials are discharged, the inside of the clean box 2 is controlled to a slightly negative pressure (−100 to −200 Pa).

First, before rotating the rotor 313, the N2 gas is supplied from the gas supply tube 610 at a fixed flow rate. This N2 gas is partially ejected out to the inside of the processing chamber 31 through the shaft sealing gap formed between the collar 325 and the casing 312*a* while circulating inside the annular groove 611*a*, and residual gas is exhausted from the exhaust passage 612 after circulating inside the circulating groove 611*b* through the shaft sealing gap formed between the collar 325 and the casings 312*a*, 312*b* and the labyrinth seal. An N2 gas is also supplied from the gas supply tube 620 at a fixed flow rate. This N2 gas circulates inside the circulating groove 621 and then is exhausted from the exhaust passage 622.

Herein, it is necessary that prevention of entering of the lubricating oil into the processing chamber 31 takes precedence over prevention of entering of particles into the bearing portion. Therefore, the N2 gas amount to be supplied to the shaft sealing means 61, 62 should be adjusted so that the exhaust passage 612 side is always at a slightly positive pressure by measuring the pressure difference between the exhaust lines that are not shown. Although there may be a case where the sealing gas supplied to the supply passage 610 ejects out into the circulating groove 621 from the shaft sealing gap formed between the collar 324*b* and the seal box 63, it is not preferable that the sealing gas supplied to the supply passage 620 ejects out into the circulating passage 611*b* from the shaft sealing gap, so that compressed air is used as the sealing gas to be supplied from the supply passage 620, an oximeter is continuously provided at the exhaust line that is joined with the exhaust passage 612, and by continuously measuring the oxygen concentration, an adjustment is possible so as to always set the exhaust passage 612 side to a slightly positive pressure.

Next, the rotor 313 is rotated at a predetermined speed. Herein, the internal pressure of the processing chamber (central portion) 31 of the particle processing apparatus changes depending on the structure of the processing chamber 31 in accordance with the processing apparatus, the shape of the rotor 313, and the speed of rotation of the rotor 313. In a case where the internal pressure is positive, the gas inside the processing chamber 31 is ejected into the annular groove 611*a* through the shaft sealing gap formed between the collar 325 and the casing 312*a*, and in a case where the internal pressure is negative, contrary to the former case, the gas inside the annular groove 611*a* is suctioned to the processing chamber 31 side through said gap. Therefore, the sealing gas supply amount is adjusted so as to eject into the processing chamber 31 from the gap even in the case of a positive internal pressure, and in the case of a negative internal pressure, an adjustment is made so that the sealing gas is supplied by an amount slightly larger than the suction amount.

The abovementioned adjustments are made by valves provided in the middle of the gas supply lines and/or exhaust lines.

Cleaning of the inside of the clean box 2 and the inside of the processing chamber 31 provided inside said box 2 is carried out according to the following procedures.

To clean the inside of the clean box 2, for example, various solvents for dissolving processed materials are sprayed from a cleaning liquid spraying device (not shown) disposed inside the box 2, and a waste liquid is drained away from a drain 25 at the lower portion of the clean box 2. At this point, by continuously supplying or exhausting the N2 gas to or from the inside of the clean box 2 in the same manner as in processing, the inside of the clean box 2 can be quickly dried.

To clean the inside of the processing chamber 31, in a condition where the rotor 313 is rotated at a low speed while continuously supplying the sealing gas (N2 gas) in the same manner as in processing, the same solvents as mentioned above are supplied from the raw material hopper 5, and a waste liquid is collected by the collector through the discharge tube 240, the discharge chute 24, and a double damper. By successively supplying (and exhausting) the N2 gas, not only the inside of the processing chamber 31 (including components) but also the raw material hopper 5, the discharge tube 240, and the discharge chute 24 can be quickly dried.

An automatic supply unit 7 supplies a quantitatively-controlled amount of a raw material to the processing chamber 31, and is composed of a supply part 71 and a drive part 72 linked to each other by a link means 73 in a manner enabling them to unlink, and attached into an attaching hole 21*a* made at the upper side of the processing chamber 31 of the frame plate 21 so that a supply port 714 is positioned immediately above the raw material hopper 5 at a predetermined space.

The drive part 72 has a bracket 721 to which a motor is attached, and is attached with bolts so that the bracket 721 is fitted into the attaching hole 21*a* from the box outer side, that is, the bracket is faced toward the box inner side to form a link means 73 for linkage to the supply part 71 at the portion of the attaching hole 21*a*, whereby the outside and inside of the box are sealed from the outside.

A screw feeder that is an example of the supply part 71 includes a screw shaft 712 for feeding a raw material supplied from the raw material hopper 711 to the processing chamber 31, and has a bearing 715 to be connected to an attaching member 713 attached to the frame plate 21, and the bearing 715 and the attaching member 713 can be easily attached and detached from the box inner side by tightening or loosening the clamp 716*a*. An oilless bearing is preferably used for the bearing.

A clamp 716*b* joins the raw material hopper 711 with the supply part 71 main body, a clamp 716*c* joins the supply part 71 main body with the bearing 715, and the supply part 71 is optionally detachable at these joints.

The link means 73 uses a so-called magnet coupling mechanism in which driven transmission is achieved by the relationship between an inner magnet 730 and an outer magnet 731 that are multipolar and are disposed at opposite sides from a partition 732 integrally molded on the attaching member 713. The magnet coupling mechanism can transmit a torque in a non-contact manner, so that the inner magnet 730 is provided at the shaft base end portion of the screw shaft 712 and the outer magnet 731 is provided at the drive shaft front end portion of the motor, and a partition 732 having a concave sectional shape is provided in the gap between this inner magnet 730 and the outer magnet 731, whereby the supply part 71 at the driven side and the drive part 72 at the drive side are completely separated from each other, and the inside and outside of the box are sealed from the inner side by the attaching member 713 and the integrally molded partition 732. Furthermore, the partition 732 is integrally molded with the attaching member 713, however, it is also possible that they are independently formed, a surface of the bracket 721 faced to the inside of the box is defined as an attaching surface, and the partition 73 is attached to the attaching surface with screws.

Thereby, raw material supply to the processing chamber 31 is carried out through the supply part 71 when a quantitatively-controlled amount supply is required, and when a quantitatively-controlled amount supply is not required, the supply part 71 is removed from the attaching member 713, the supply port 714 is turned sideward, or the space between the supply port 714 and the raw material hopper 5 is set to be wider to make it possible that these members can be selectively used so that a raw material is directly supplied from the raw material hopper 5.

Furthermore, the automatic supply unit 7 is structured so that the entirety including the drive part 72 is attachable to and detachable from the frame plate 21, and when the entirety is detached, the inside and outside of the box are sealed by fitting a cover member to the attaching hole 21*a*, and when the automatic supply unit 7 is attached and only the supply part 71 is detached, a cover member is fitted to the attaching member 713 to prevent particles from entering recesses of the link means 73 (partition 732).

In the present embodiment, a structure is shown which uses the raw material hopper 5 as it is, however, it is also possible that the raw material hopper 5 is removed, and the supply port 714 is joined with the raw material pouring tube 51 via a joint tube to form a supply path for directly supplying a raw material to the processing chamber 31. In this case, when a pulverizer that adjusts the internal pressure of the processing chamber 31 during operation is used, it is also allowed that a gas flow inlet for supplying gas flows generated in accordance with rotation of the impact pins 313 is provided immediately above the supply port 714 and the raw material hopper 711 is attached to and detached from this gas flow inlet in accordance with the requirement of or non-requirement of a quantitatively-controlled amount supply.

Furthermore, it is also allowed that the joint tube is formed from an air permeable material, and a required gas amount is suctioned from the inside of the box through the tube.

As the automatic supply unit 7, in place of the screw feeder, a rotary valve or a table filter can be employed, and in place of the magnet coupling mechanism of the link means 73, a general joint mechanism using an irregularity engagement can be employed only if a quantitatively-controlled amount supply can be properly carried out and these members can be optionally attached and detached when cleaning the inside of the box.

In the embodiment of the invention structured as mentioned above, a raw material is pulverized by rotating the rotor 313. The frame plate 21 that is a part of the outer wall of the clean box 2 has a function as an attaching structure to the base 1, and at the outside of the frame plate 21, a sealing means for maintaining sealing performance of the inside and outside of the box 2 is integrally provided, and the processing chamber 31 is provided in close contact with the frame plate 21 via the casings 312*a*, 312*b*. Therefore, the processing chamber 31 is securely supported by the frame plate 21 in a integrated manner with the clean box 2. As a result of such integrated structure of the processing chamber 31, the clean box 2, and the sealing means not only makes the entirety compact but also shortens the rotary shaft 320 to be inserted into the clean box 2, and makes high speed rotation of the rotor possible. Furthermore, when cleaning the inside of the clean box 2, the inside of the processing chamber 31, and the shaft sealing means 6, cleaning can be carried out in a state that the clean box 2 and the drive mechanism 32 are attached to the base 1, and the components such as the stator 311 and casings 312*a* and 312*b* forming the processing chamber 31 and the shaft sealing means 6 can be disassembled in the same manner as in the related art, whereby it becomes possible to easily carry out disassembly and assembly accompanied with cleaning work in a short time.

For the sealing means, because the member seal boxes 63, 64 comprising the shaft sealing means 6 are commonly used it is not necessary to additionally provide a cover member, the number of parts can be reduced, and the drive mechanism 32 can be provided in proximity to the sealing means.

Namely, inside and outside the clean box 2 based on the sealing means, the first shaft sealing means 61 is formed opposing the processing chamber, and the second shaft sealing means 62 is formed opposing surfaces the oil seal 323.

By forming the first shaft sealing means 61 inside the clean box 2, the rotary shaft 320 inside the clean box 2 can be shortened, and accordingly, the outside rotary shaft 320 can also be shortened, and high speed rotation of the rotor 313 is made possible without a great increase in thickness of the rotary shaft 320, and in addition, particles are prevented from entering the drive mechanism side, and fine particles can also be handled. Furthermore, since the first shaft sealing means 61 can be formed in a state where the frame plate 21 is held between the sealing means and the casing 312*b*, the thickness region of the outer wall can be efficiently used, and this is very effective for downsizing of the entire apparatus.

Furthermore, a sealing gas circulating path formed by the first shaft sealing means 61 is formed across the gas supply passage 610 inside the clean box 2 and the exhaust passage 612 outside the clean box, and divided into the processing chamber 31 side and the drive mechanism 32 side, so that when particles enter from the processing chamber 31, the entering particles are received by the annular groove 611*a* and turned toward the annular 611*b* side, and then discharged from the exhaust passage 612 together with the flow-in sealing gas G. A divided structure is obtained in which, based on this sealing gas circulating path as a boundary, the processing chamber 31 inside the clean box 2 and the drive mechanism 32 side outside the clean box 2 are securely divided. Furthermore, when cleaning the inside of the clean box 2 while maintaining airtightness inside the clean box, sealing can be secured by only closing the exhaust passage 612.

Furthermore, when disassembling the processing chamber, since the sealing gas circulating path can be vertically divided so that the seal boxes 63 and 64 are exposed by removing the casing 312*b*, isolation from the outside can be secured by the seal boxes 63 and 64, and even when the shaft scaling means 6 and the oil seal 323 are disposed in proximity to each other, the oil seal 323 is prevented from being directly exposed to the outside, and also, when cleaning the inside of the clean box 2, the oil seal 323 is protected and entering of a cleaning liquid is prevented.

Furthermore, the sealing gas circulating path formed by the second shaft sealing means 62 functions as a region for adjusting the space between the sealing means and the oil seal 323, and can be used as necessary by taking into consideration physical properties and particle size of a processing raw material, or the width of this space.

Namely, in the relationship with the first shaft sealing means 61, this second shaft sealing means 62 allows entering of particles from the first shaft sealing means 61 and entering of foreign substances from the drive mechanism 32 side to restrain these particles from entering the drive mechanism 32 side and the foreign substances from entering the first shaft sealing means 61 side.

Therefore, even when the seal box 63 and the oil seal 323 are disposed in proximity to each other, entering of the lubricating oil at the bearing to the first shaft sealing means 61 at the particle processing chamber side and entering of particles to the oil seal 323 are reliably prevented by the second shaft sealing means 62 at the drive mechanism side, adjustments, management, and control of the gas flowing-in amount can be easily carried out, the product yield with respect to particles is improved, necessity of replacement due to breakage of the oil seal or influence from breakage of the oil seal on the entire apparatus can be eliminated or reduced to a minimum, whereby fine particle processing by high speed rotation can be carried out in a clean box that is demanded to be compact.

Furthermore, the shaft sealing means 61, 62 comprises sealing gas circulating paths that are independently formed for taking-in and exhaust of the sealing gas G, setting and adjustments of the flowing-in gas pressure can be individually carried out, and adjustments, management, and control of the gas flowing-in amount can be easily carried out.

Furthermore, the first shaft sealing means 61 and the second shaft sealing means 62 communicate with each other through the shaft sealing gap formed between the collar 324*b* and the seal box 63, and the sealing gas G flowing-in pressure of the second shaft sealing means 62 is set lower than that of the first shaft sealing means 61.

Thereby, control can be made so that the sealing gas G of the first shaft sealing means 61 is allowed to enter the second shaft sealing means 62 side, however, the sealing gas of the second shaft sealing means 62 is restrained from entering the first shaft sealing means 61 side, and therefore, regardless of an operator's skill, the gas flowing-in amount can be easily adjusted, managed, and controlled.

Namely, when particles enter the first shaft sealing means 61 from the processing chamber 31, the entering particles are received by the annular groove 611*a* and turned toward the annular groove 611*b* side, and then discharged from the exhaust passage 612 together with the flowing-in sealing gas G, and even if the particles are not discharged from there and enter the annular groove 612 of the second shaft sealing means 62 that has been set to a low pressure, the particles can be discharged from the exhaust passage 622. On the other hand, when foreign substances such as oil at the oil seal 323 through the rotary shaft 320 enters the second shaft sealing means 62, such foreign substances are received by the annular groove 612 and discharged from the exhaust passage 622. Thereby, entering of particles to the oil seal 323 side and entering of foreign substances such as oil to the inside of the processing chamber 31 can be reliably prevented.

Furthermore, even if foreign substance such as oil enters the annular groove 611*b* from the annular groove 621, such foreign substance can be prevented from entering the annular groove 611*a* side by the oil thrower 326 and the labyrinth seal formed by the labyrinth ring 325*a* and the surrounding annular groove and securely discharged from the exhaust passage 612.

Next, to thoroughly clean the respective parts comprising the processing chamber 31 and the shaft sealing means 6, first, the clamp 241 is removed, and the clamp 52 is removed and the raw material hopper 5 is removed. Then, the knob nut 26*b* is loosened (or removed), the front cover 310 is removed, and thereafter, the bolt 4 and the rotor 313 are removed from the shaft 320. Thereafter, the stator 311, the casing 312*a*, the collar 325, the casing 312*b*, the collar 324*a*, and the oil thrower 326 are removed in this order. Then, the parts are cleaned and dried inside the clean box 2 or after being taken to the outside. At this point, the components including the front cover 310, the stator 311, and the casings 312*a*, 312*b* can be assembled, attached, and disassembled by supporting the engaging arms 33 on supporting members 26 that are supported at one-side ends on the frame plate 21, and by fixing the front cover 310 by the tightening means 26*a*, 26*b*, so that the setting means of the components accompanied with assembly, attachment, and disassembly are integrated, and this simplifies the entire assembling and attaching structure and reduces the number of parts. Therefore, even when the components are structured into a quadruple-layered structure, the components can be set in a temporarily assembled or temporarily attached condition in a multi-layered manner by only supporting them with a supporting member. Furthermore, disassembly from this temporarily assembled or temporarily attached condition is possible, so that the necessity of supporting of the components during works is eliminated, and this makes it possible for one person to carry out the works, and furthermore, only optional components can be removed as necessary, so that works can be very efficiently carried out. Furthermore, a general tightening means such as a combination of bolts and nuts that are attachable and detachable can be employed to eliminate the necessity of directly forming of tightening means on the front cover 310 and the frame plate 21, and particularly, it becomes possible to eliminate the necessity of additionally providing a fixing means or a tightening handle, and molded portions such as projections and holes due to the existence of such fixing means or a tightening handle can be made unnecessary, and not only disassembled components but also an attaching structure to which the components are attached can be easily cleaned. Therefore, even when frequencies of assembly, attachment, and disassembly are high in accordance with that of processing raw material changeovers, productive efficiency is maintained, and even inside the clean box at which these works are difficult to perform, disassembly, assembly, and attachment accompanied with cleaning work can be carried out in a short time.

In addition, since the components are coaxially supported by the supporting members 26, the components can be set at predetermined positions by engaging the concave grooves 331 of the engaging arms 33 with the supporting members 26 and sliding the arms, and it can be avoided that assembly, attachment, and disassembly of the components involve horizontal turning operations of the front cover 310, the set structure is formed compact, and even in the limited space inside the clean box, setting operations of the components can be accurately and easily carried out.

Furthermore, the supporting members 26 are formed of columnar rods. With this structure engagement with and cleaning of the concave groove 331 are easily carried out, and when the engaging arms 33 are supported on the supporting members 26, the components can be set or drawn out in optional directions reaching upward directions from the axial line directions with respect to the supporting members and in optional postures reaching the inclined postures from the vertical postures. The components can be assembled, attached, and disassembled by only loosening the knob nut 26*b* without removing the knob nut, and even if there is a difference in operator heights or setting the height of the apparatus, setting or drawing-out works are easy, and disassembly, assembly, and attachment following cleaning work can be easily carried out in a short time.

The engaging arm 33 of the casing 312*b* is smaller than those of other components including the front cover 310. Therefore even when the engaging arm 33 of the adjacent casing 312*a* that has a relatively narrow width is disposed in proximity, the arms are easily held and operated. As a result the structure prevents operator's fingers from being caught between the engaging arms 33 and 33.

On the other hand, in view of a short- or long-period supply state, when selective use of a supply unit is required between the case requiring the supply unit and the case not-requiring the supply unit, the automatic supply unit 7 is attached to the attaching hole 21*a* of the frame plate 21. The supply unit 7 is structured so that the supply part 71 and the drive part 72 are linked to each other by a predetermined link means 73 in a manner enabling them to unlink, so that the supply part 71 and the drive part 72 can be attached to the inside of the box and the outside of the box, respectively, in a divided manner.

Furthermore, when attaching these members, while the drive part 72 is faced to the box inner side so as to form a link means with the supply part 71 at the attaching hole 21*a* and attached to the outside of the attaching hole 21*a* by bolts or the like, and the supply part 71 is attachable to and detachable from the box inner side together with the link means 73. Therefore, according to the raw material processing amount or supply manner in the production process, selective use between a case requiring a quantitatively-controlled amount supply and a case that does not need a quantitatively-controlled amount supply is possible in a condition where the sealed condition of the outside and inside of the clean box 2 is maintained. For example, when use without necessity of the supply unit 7 is required, the supply unit 7 itself is removed, only the supply part 71 is removed, or the supply port 714 is turned sideward, whereby a raw material can be directly supplied to the processing chamber 31 from the raw material hopper 5 (or 711), and even when assembly, disassembly, and cleaning of the processing chamber 31 are frequently carried out, it is not especially forced to carry out cleaning of the supply part 71 inside the box. Furthermore, use involving the supply unit 7 is required, in view of a short- or long-period supply manner, the entire supply unit 7 or the supply unit 71 when the supply unit 7 has already been attached can be selectively attached or detached in accordance with the supply manner, and therefore, combined with the case where the supply unit is unnecessary, attachment and detachment of the supply unit can be carried out necessarily at a frequency lower than that of assembly, disassembly, and cleaning of the processing chamber 31.

Therefore, in comparison with a structure which always includes a supply unit, balanced use is possible between attachment and detachment accompanied with cleaning work and attachment and detachment in accordance with necessity and needlessness of a quantitatively-controlled amount supply, which will result in the reduction of the work burden.

Furthermore, raw material supply to the processing chamber 31 is carried out via the supply unit 7 (supply part 71) in the case requiring a quantitatively-controlled amount supply. In the case where a quantitatively-controlled amount supply is not required, the arrangement of the raw material hopper 5 or the raw material hopper 711 to be provided at the supply part 71 is changed so that the respective components can be selectively used to realize direct supply of the raw material, and the limited space inside the box can be simplified and efficiently used without an increase in the number of parts.

Then, the raw material hopper 5 of the processing chamber 31 is disposed below the supply unit 7 (supply part 71) at a predetermined space so that a raw material supplied from the supply part 71 is supplied to the processing chamber 31 via the raw material hopper 5. With the structure a gap is created between the supply port 714 and the raw material hopper 5, and in the case where the processing apparatus is a pulverizer, the space can serve as an air vent for air flows generated due to rotation of the impact pins 313*a*. Furthermore, in both cases where a quantitatively-controlled amount supply is required or not required, it is possible to pour the raw material into the raw material hopper 5 without removal of the supply part 71, and this significantly improves processing efficiency.

Furthermore, the supply part 71 is detachably joined with the attaching member 713 attached to the frame plate 21 together with the bearing 715 portion that is distant from the frame plate 21 so that the tightening operation of the clamp 716 becomes easy. Needless to say, it is allowed to employ a structure in which the supply part 71 is directly provided on the frame plate 21.

By fitting the attaching hole 21*a* with the bracket 721 from the box outside, the inside and outside of the box are sealed, so that when the supply part 71 is removed, this removal does not influence the environment inside the box, and by a simple structure in which a cap or a cover material is only attached to the removed portion, processed particles can be prevented from entering recesses of the link means 73 (partition 732) during operation.

Furthermore, the link means 73 is composed of a so-called magnet coupling mechanism that achieves driven transmission due to the relationship between a multi-polar inner magnet 730 and outer magnet 731 disposed across the partition 732, so that the box inner side and the drive part 72 side can be completely partitioned and sealed.

Moreover, the partition 732 is integrally formed on the attaching member 713, across the frame plate 21, in conjunction with the bracket 721 outside of the box, a reliably sealed structure from the inside of the box can be obtained, and cleaning in a condition where the cap is removed becomes easier.

The attaching structure of the supply unit 7 in the present embodiment is illustrated in the relationship with the clean box 2, however, the invention is not limited to this, and such a structure can be employed in a general unit that includes no clean box.

INDUSTRIAL APPLICABILITY

The present invention relates to a particle processing apparatus structured so that, via an outer wall composing a clean box 2, a particle processing chamber 31 is disposed inside the box and a drive mechanism 32 including drive rotary bodies 320, 324, 325 is disposed outside the box, and a rotor 313 provided inside the processing chamber 31 and the drive rotary bodies 320, 324, 325 are connected with each other, wherein the outer wall of the clean box 2 and a base 1 on which the drive mechanism 32 is installed are integrally attached via a sealing means so that sealing performance inside and outside the box is maintained from the outside of the outer wall, and the processing chamber 31 is provided in close contact with the outer wall via a casing 312 disposed inside the clean box 2 to capable of disassembly inside the box. With this structure the processing chamber can be securely supported by the outer wall of the clean box, the processing chamber 31 and the clean box 2 can be integrated, the rotary shaft 320 inside the clean box 2 can be shortened, high speed rotation of the rotor 313 is enabled, and in a condition where the clean box 2 and the drive mechanism 32 are attached to the base, components comprising the processing chamber 31 and the shaft sealing means 6 can be disassembled, and therefore, disassembly and assembly accompanied with cleaning work can be easily carried out in a short time.

Furthermore, the invention relates to a particle processing apparatus 3 structured so that, via an outer wall composing a clean box, a particle processing chamber is disposed inside the box and a drive mechanism including a drive rotary body is disposed outside the box, a drive rotary body 320 of the drive mechanism 32 is inserted into the particle processing chamber 31 via a shaft sealing means 6, and a rotor 313 interlocked and rotatably joined with the drive rotary body 320 is provided, wherein the shaft sealing means 6 is composed of a first shaft sealing means 61 for restraining particles to be processed in the particle processing chamber 31 from entering the drive mechanism 32 side and a second shaft sealing means 62 provided between the first shaft sealing means 61 and the drive mechanism 32, the second shaft sealing means 62 allows entering of particles from the first shaft sealing means 61 and entering of foreign matter from the drive mechanism 32 side thereby restrains entering of the particles to the drive mechanism 32 side and entering of the foreign matter to the first shaft sealing means 61 side. With this structure even when the shaft sealing means 6 and the oil sealing means 323 are disposed in proximity to each other due to compactness of the entire apparatus, entering of a lubricating oil to the first sealing means 61 at the particle processing chamber side and entering of particles to the oil sealing means 323 can be securely prevented by the second sealing means 62 at the drive mechanism side. As a result, adjustments, management, and control of the gas flowing-in amount can be easily carried out, the product yield of the particles is improved, necessity of replacement due to breakage of the oil sealing means or influence from breakage of the oil sealing means on the entire apparatus can be eliminated or reduced to a minimum, and even in a clean box that has been demanded to be compact, processing of fine particles by high speed rotation is enabled.

Furthermore, the invention relates to a particle processing apparatus which is divided by an outer wall composing a clean box into a particle processing chamber side disposed inside the clean box and a drive mechanism side disposed outside the box, and divided into the particle processing chamber side and the drive mechanism side via a predetermined attaching structure such as a base, a casing, a frame plate or the like, wherein in order to attach optional components such as a casing, a stator, and a front cover to be disposed at the processing chamber side to the attaching structure in a multi-layered manner capable of disassembly, a pair of supporting members 26 having tightening means at the front ends are supported on the attaching structure at one-side ends of the supporting members (in cantilever manner), and on the other hand, engaging arms 33 which engage the supporting members 36 are formed on the respective components, and said components are structured to be capable of disassembly by supporting and fixing the engaging arms 33 to the supporting members 26 by the tightening means, whereby the setting means for the components, which are necessary for assembly and disassembly are united, this simplifies the entire attaching structure and reduces the number of parts. Further even when the components are structured into a multi-layered structure, the components can be set in a temporarily attached condition in a multi-layered manner by only supporting them on the supporting members 26. Therefore, it becomes unnecessary to continuously support the components during works, one operator can complete works by himself/herself, and assembly work becomes simple and working efficiency is improved, and also, it becomes possible to employ a general tightening means such as a combination of bolts and nuts, necessity of additionally providing a fixing means or a tightening handle can be avoided, and a molded portion of projections and holes due to the existence of these members can be made unnecessary, cleaning of not only disassembled components but also an attaching structure to which the disassembled components are attached can be easily carried out. Therefore, even when assembly, disassembly, and cleaning frequencies increase, disassembly and assembly accompanied with cleaning work even inside the clean box 2 at which such works are difficult to perform can be easily carried out without loss of productive efficiency.

Moreover, according to the invention, in order to attach a supply unit 7 which supplies a quantitatively-controlled amount of raw materials to the processing chamber 31, said supply unit is composed of a supply part 71 and a drive part 72 that are linked to each other by a predetermined link means 73 in a manner enabling them to unlink, an attaching hole 21*a* for attaching the supply unit is made in the outer wall above the location at which the processing chamber 31 is disposed, and the drive part 72 is attached to the outside of the attaching hole 21*a* by being faced to the box inner side so as to form a link means to the supply part 71 at the attaching hole 21*a* portion, and the supply part 71 is structured so as to be detachable together with the link means 73 from the box inner side, whereby selective use between cases which requires or does not require a quantitatively-controlled amount supply can be made in accordance with the raw material processing amount and supply manner in the production process while maintaining the sealed conditions of the inside and outside of the clean box. For example, when use without the supply unit 7 is required, a raw material can be directly supplied from the predetermined raw material hopper 5 (or 711) to the processing chamber 31, and even when assembly, disassembly, and cleaning of the processing chamber 31 are frequently carried out, not only in a case where the entire supply unit 7 is removed, but also in a case where the supply unit 7 is attached, by removing the supply part 71, it is not especially forced to clean the supply unit 7. Furthermore, when use involving the supply unit 7 is required, in view of a short- or long-period supply manner, the attaching and detaching operations of the entire supply unit or only the supply part 71 can be selectively carried out, and combined with the case where the supply unit is unnecessary, attachment and detachment can be necessarily carried out at a frequency lower than the frequencies of assembly, disassembly, and cleaning of the processing chamber, and therefore, in comparison with a construction in which the supply unit 7 is always attached, balanced use is possible between attachment and detachment accompanied with cleaning work and attachment and detachment according to necessity or needlessness of a quantitatively-controlled amount supply, and this reduces the work burden.

What is claimed is:

1. A particle processing apparatus comprising a particle processing chamber disposed inside a clean box and a drive mechanism including a drive rotary body disposed outside the clean box via an outer wall composing the clean box, said drive rotary body connected to a rotor provided inside the processing chamber, characterized in that the clean box is attached to a base on which the drive mechanism is installed, a sealing means fitted to the outer wall at a fitting portion of the rotary body so that sealing performance inside and outside the box is maintained from the outside of the outer wall, and the processing chamber provided in close contact with the outer wall via a casing disposed inside the clean box so as to be integrated with the clean box and the sealing means, and structured so as to be disassembled inside the box, the apparatus further comprising, a sealing gas circulating path for supply and exhaust of a sealing gas is formed between opposing surfaces of the sealing means and the processing chamber, the circulating path is formed as a shaft sealing means for restraining particles to be processed by the rotor from entering the drive mechanism side, and the sealing means is commonly used as a component of the shaft sealing means.

2. The particle processing apparatus according to claim 1, characterized in that the sealing gas circulating path is formed across the inside and the outside of the clean box so as to be dividable into the processing chamber side and the drive mechanism side.

3. The particle processing apparatus according to claim 1, wherein the sealing gas circulating path is formed so as to be vertically dividable so that the sealing is exposed when the processing chamber is disassembled.

4. The particle processing apparatus according to claim 1, wherein shaft sealing means is defined as a first shaft sealing means, and at the drive mechanism side of the sealing means, a second shaft sealing means for restraining a lubricating oil at the bearing from entering the first shaft sealing means side from the oil sealing means provided at the drive mechanism is provided.

5. The particle processing apparatus according to claim 4, wherein the first shaft sealing means and the second shaft sealing means are communicated with each other via a shaft sealing gap between the drive rotary body and seal boxes, and the second shaft sealing means is set to have a pressure lower than a sealing gas pressure of the first shaft sealing means so as to allow entering of a sealing gas from the first shaft sealing means through said shaft sealing gap.

6. The particle processing apparatus according to claim 1, wherein each of the shaft sealing means is composed of a sealing gas circulating path for supply and exhaust of a sealing gas, which is independently formed.

7. A particle processing apparatus comprising a particle processing chamber disposed inside a clean box and a drive mechanism including a drive rotary body disposed outside the clean box via an outer wall composing the clean box, said drive rotary body of the drive mechanism fitted into the particle processing chamber via a shaft sealing means, a rotor provided inside the particle processing chamber rotatably connected to said drive rotary body, characterized in that the shaft sealing means is composed of a first shaft sealing means for restraining particles to be processed in the particle processing chamber from entering the drive mechanism side and a second shaft sealing means provided between the first shaft sealing means and the drive mechanism, each of the shaft sealing means composed of a sealing gas circulating path for supply and exhaust of a sealing gas which is independently formed, said second shaft sealing means allowing particles from the first shaft sealing means and foreign substances from the drive mechanism side to enter the second shaft sealing means, thereby restraining the particles from entering the drive mechanism side and foreign substances from entering the first shaft sealing means side.

8. The particle processing apparatus according to claim 7, wherein said drive mechanism is provided with a predetermined oil sealing means, the foreign substances from the drive mechanism side being a lubricating oil at the bearing in the drive mechanism.

9. The particle processing apparatus according to claim 7, wherein each of the shaft sealing means is composed of a sealing gas circulating path for supply and exhaust of a sealing gas, which is independently formed.

10. The particle processing apparatus according to claim 7, wherein the first shaft sealing means and the second shaft sealing means are communicated with each other via a shaft sealing gap between the drive rotary body and seal boxes, and the second shaft sealing means is set to have a pressure lower than a sealing gas pressure of the first shaft sealing means so as to allow entering of a sealing gas from the first shaft sealing means through said shaft sealing gap.

11. A particle processing apparatus which is divided into a particle processing chamber side disposed inside a clean box and a drive mechanism side disposed outside the clean box by an outer wall composing the clean box, and divided into the particle processing chamber side and the drive mechanism side via a predetermined attaching structure including at least one of a base, a casing, and a frame, wherein in order to assembly and disassembly attach components comprising one or more of at least a casing, a stator and a front cover provided at the processing chamber side to the attaching structure in a multi-layered manner, a pair of supporting members having tightening means at the front ends are supported on the attaching structure in cantilever manner, said respective components provided with engaging arms to engage the supporting members, said components structured so as to be capable of assembly and disassembly by supporting and fixing the engaging arms to the supporting members by using the tightening means.

12. The particle processing apparatus according to claim 11, characterized in that the components are coaxially supported by the supporting members.

13. The particle processing apparatus according to claim 11, wherein the attaching structure is the outer wall composing the clean box.

14. The particle processing apparatus according to claim 11, wherein the supporting members are columnar rods.

15. The particle processing apparatus according to claim 11, wherein in order to support the engaging arms on the supporting members, downward concave grooves formed in the engaging arms are fitted over the supporting members, and the components are structured so as to be capable of assembly and disassembly in optional postures in optional upward directions from the axial line directions with respect to the supporting members.

16. The particle processing apparatus according to claim 11, wherein the engaging arms are formed so as to be different in size between the front cover and other components and to be able to hold.

17. A particle processing apparatus comprising a particle processing chamber disposed inside a clean box and a drive mechanism including a drive rotary body disposed outside the clean box via an outer wall composing the clean box, a rotor provided inside the processing chamber rotatably connected to said drive rotary body, said particle processing apparatus further comprising a material supply unit disposed in the clean box so as to supply a quantitatively-controlled amount of a raw material constantly to the processing chamber, said material supply unit characterized in that it comprises a supply part and a drive part which are linked by a predetermined link means in a manner enabling them to unlink, an attaching hole for attachment of the supply unit formed in the outer wall above the location at which the processing chamber is disposed, said drive part attached to the outside of the attaching hole by being faced to the box inner side so as to form a link means to the supply part at the attaching hole portion, said supply part structured so as to be detachable from the box inner side together with the link means.

18. The material supply unit disposed in the clean box according to claim 17, characterized in that material supply to the processing chamber is carried out in such a selective manner that a raw material is supplied via the supply unit when a quantitatively-controlled amount supply is required, and is supplied directly from a first raw material hopper when a quantitatively-controlled amount supply is not required.

19. The material supply unit disposed in the clean box according to claim 18, characterized in that the supply unit is disposed at a predetermined space above the first raw material hopper that is directly provided on the processing chamber so that a raw material from the supply unit is supplied to the processing chamber through the first raw material hopper.

20. The material supply unit for the clean box according to claim 18, characterized in that when a quantitatively-controlled amount supply is required, the second raw material hopper attached to the supply unit is used.

21. The material supply unit disposed in the clean box according to claim 17, wherein the supply part is structured so as to be attachable to and detachable from an attaching member attached to the frame plate.

22. The material supply unit for the clean box according to claim 17, characterized in that the inside and outside of the box are sealed by fitting a bracket composing the drive part to the attaching hole from the outside of the box, and the link means is composed of a magnet coupling mechanism which achieves driven transmission due to the relationship between multi-polar inner magnet and outer magnet that are disposed across a partition that partitions the supply part side and the drive part side.

23. The material supply unit disposed in the clean box according to claim 22, characterized in that the partition is integrally formed on the attaching member.

24. The material supply unit disposed in the clean box according to claim 17, wherein the supply part is composed of a screw feeder, said screw feeder conveying a raw material supplied to the second raw material hopper, to the processing chamber.

* * * * *